United States Patent [19]

Laughlin

[11] 4,059,740

[45] Nov. 22, 1977

[54] SWITCH AND OPERATING MECHANISM FOR CIRCULAR HOSIERY KNITTING MACHINE SPEED CONTROL

[76] Inventor: John M. Laughlin, 225 Roseboro Drive, Asheboro, N.C. 27203

[21] Appl. No.: 669,763

[22] Filed: Mar. 24, 1976

[51] Int. Cl.[2] ..... H01H 29/00; H01H 35/00; D04B 35/10

[52] U.S. Cl. ..... 200/52 R; 66/157; 66/163; 200/203; 200/216

[58] Field of Search ..... 66/56, 157, 160–163, 66/154 A; 200/52 R, 33 A, 182, 202, 203–206, 208, 215–219, 220, 153 T, 302, 38 B, 38 C

[56] References Cited

U.S. PATENT DOCUMENTS

| | | | |
|---|---|---|---|
| 1,831,845 | 11/1931 | Cramblet | 200/216 |
| 1,903,989 | 4/1933 | Fink et al. | 200/52 R UX |
| 1,930,983 | 10/1933 | Russell | 200/205 X |
| 2,251,385 | 8/1941 | Wade et al. | 200/203 |
| 2,274,035 | 2/1942 | Brown | 200/52 R UX |
| 2,444,285 | 6/1948 | Doss | 200/33 A X |
| 3,213,215 | 10/1965 | Fonda | 200/219 X |
| 3,335,246 | 8/1967 | Romanowski | 200/216 |
| 3,390,548 | 7/1968 | Rogerson et al. | 66/163 |

FOREIGN PATENT DOCUMENTS

| | | | |
|---|---|---|---|
| 772,716 | 11/1934 | France | 200/215 |

*Primary Examiner*—James R. Scott

[57] ABSTRACT

A mercury switch which operates the speed control of a circular hosiery knitting machine is positioned within an elongated chamber of a switch housing. The switch housing, in turn, is pivotally mounted to the frame of a knitting machine at such a position as to be operated by a lever responsive to progression of the pattern chain and/or cam drum, and alternately tilted between a "switch activated" and "switch deactivated" position. The mercury switch is so arranged within the housing that when the housing is lowered to the deactivated position, the mercury is disengaged from the contacts of the switch, and when the housing is raised to the activated position, the mercury is caused to move by gravity down into engagement with the contacts of the switch. The mercury switch is completely sealed within the housing, so that oil, oil vapors, dust and the like cannot work thereinto.

4 Claims, 3 Drawing Figures

SWITCH AND OPERATING MECHANISM FOR CIRCULAR HOSIERY KNITTING MACHINE SPEED CONTROL

BACKGROUND OF THE INVENTION

In certain types of circular knitting machines, notably the Textile Machine Works knitting machine, types of Mark III, Mark IIIS, and Mark IV, a microswitch is mounted on the machine adjacent the pattern chain and cam drum, and is operated through a lever mechanism, selectively activated by protruding lugs on the pattern chain and cams on the drum. The lever mechanism, when thusly activated, engages the contact arm of the microswitch to complete a circuit, sending impulses to a solenoid to selectively shift the drive belt of the needle cylinder between a fast and slow speed pulley.

Considerable difficulty has been encountered with the microswitch in that either oil works its way into the interior of the microswitch and causes a carbon buildup on the contacts, preventing good electrical contact between the activator arm and one of the contacts, or else the activator arm, which is a thin metallic plate, breaks after a short time due to the constant wear.

As a result such microswitches must be replaced on the knitting machines periodically, sometimes as often as monthly, causing added expense and down time of the machine. Further, if the contact strip breaks during usage, the drive belt is not shifted from the fast to the slow speed pulley prior to the pattern shift and considerable damage can be done to the needle cylinder, resulting in the machine being down for several hours.

Efforts to solve this problem have, so far, been unsuccessful.

SUMMARY OF THE INVENTION

The present invention, however, is directed to an improved switching device, which replaces the conventional microswitch arrangement. Toward this end, a switch housing having an elongated chamber therein receives a mercury type switch and is pivotally mounted to the machine for arcuate movement between a first position in which one end of the chamber is tilted downwardly and a second position in which the one end is tilted upwardly The mercury switch is so mounted within the chamber that the leads thereof exit through the end of the chamber opposite the one end which is tilted upwardly and downwardly. Therefore, when the one end of the chamber is tilted downwardly the mercury is out of engagement with the contacts of the leads and when the same one end is tilted upwardly the mercury is moved down the tube into engagement with the contacts completing the circuit to the solenoid which shifts the drive belt. The switch housing includes a depending finger which is engaged by the conventional lever arrangement during operation for moving the switch housing between the aforementioned first and second positions responsive to movement of the lever by lugs on the pattern chain and cams on the cam drum.

It is, therefore, an object of the present invention to provide improvements in the switching arrangement of the speed control mechanism for circular hosiery knitting machines.

It is further an object of the present invention to provide an improved switching device for the speed control mechanism of circular hosiery knitting machines in which the switch is sealed and without relative movement of switch parts, thereby minimizing deterioration or wear during operation.

Other objects and a fuller understanding of the invention will become apparent from reading the following description of a preferred embodiment in view of the accompanying drawings in which.

DETAILED DESCRIPTION OF A PREFERRED EMBODIMENT

Figure 1:
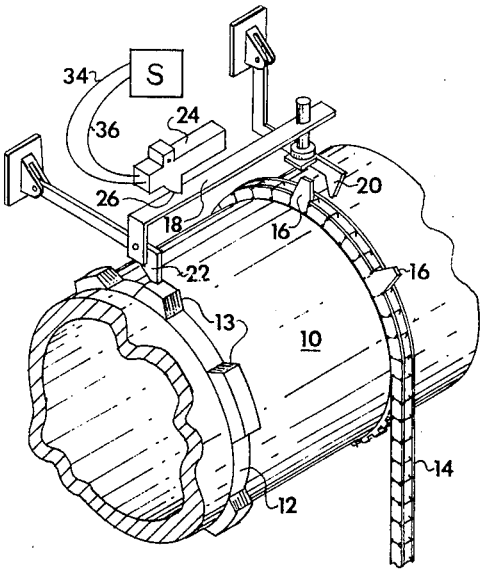
FIG. 1 is a perspective view, partially in schematic, and with parts broken away, illustrating the switch mechanism according to the present invention, and its relationship to the pattern chain, cam drum and drive belt control solenoid.
Figure 2:
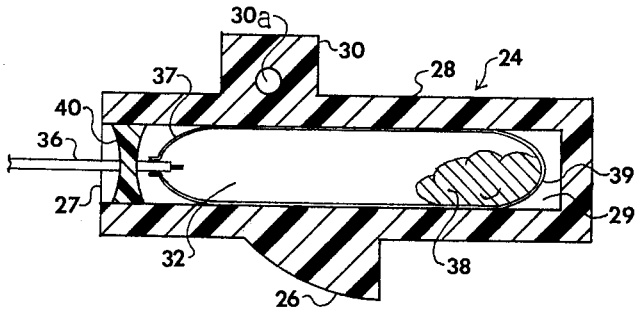
FIG. 2 is an enlarged, cross-sectional view of the switch mechanism itself removed from the knitting machine.

Turning now to a discussion of the preferred embodiment of the invention, there is schematically illustrated in FIG. 1 a conventional cam drum 10 having a plurality of cam tracks 12, and the pattern chain 14 having a plurality of lugs 16 protruding upwardly from one edge thereof. A lever 18 is conventionally attached to the machine in some suitable manner, so that a first downwardly extending leg 20 is positioned in the path of lugs 16 as the pattern chain moves. A second downwardly extending leg 22 is similarly positioned in the path of cams on one of the cam tracks 12.

The switch mechanism 24, according to the present invention, is pivotally mounted to the knitting machine at the same, already available mounting position as occupied by the replaced microswitch on most machines. It should be pointed out that on the aforementioned Mark IV machine, an adapter bracket (not shown) must be provided as the regular mounting holes on the Mark IV are oriented angularly rather than horizontally. A protuberance 26 or other portion of housing 24 is engaged by or rests against the upper surface of lever 18. The switch housing 24 includes a mercury switch sealed therein and having the leads thereof connected to a solenoid S, which operates in a conventional manner to shift a drive belt back and forth between a slow speed pulley and a fast speed pulley responsive to alternate pulses from the switching mechanism. The operation of lever 18 by the pattern chain 14 and cam track 12 is conventional and well known, and the applicant of the present invention does not make any claim to this facet of the structure. Also, the solenoid and the manner in which it operates the drive belt between the fast and slow speed pulleys responsive to signals or pulses from some type switch mechanism is also conventional.

What is new in the present invention is the switching mechanism itself, and the way it provides protection for the switch therein, so as to provide longer life and trouble free operation.

Figure 3:
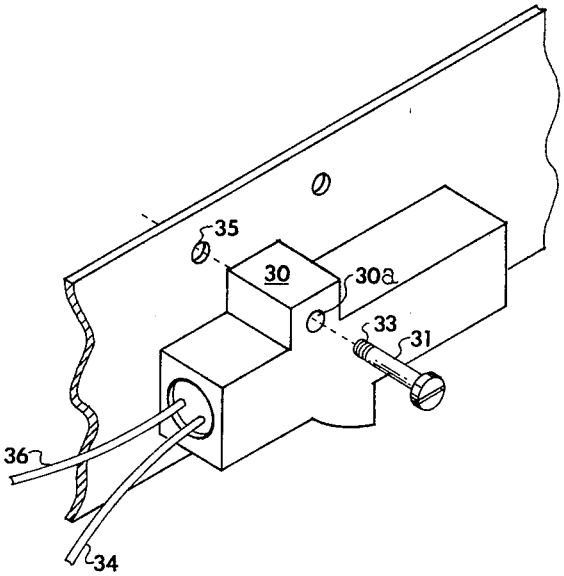
FIG 3 is a perspective view of the switch housing itself, illustrating a portion of the frame of the machine onto which the switch housing is mounted.

Specifically referring to the switch mechanism, the switch housing 24 includes an elongated body portion 28 with an elongated interior chamber 29 therein. A projection 30 protrudes upwardly from and extends transversely across the upper wall of body portion 28 and includes an opening **30*a* therethrough through which a fastener 31 extends to pivotally attach the housing 28 to a position on the knitting machine formerly occupied by the replaced microswitch. As illustrated in FIG. 3, the shaft of fastener 31 is threaded at the end 33 and is unthreaded or smooth in the intermediate portion which extends through opening 30***a* and provides a bearing surface for housing 24 as it pivots responsive to mechanical activation from the pattern chain and cam drum. The threaded mounting hole in the machine frame is already present, and does not have to be drilled when retro-fitting machines in the field with the new switch mechanism.

A mercury switch 32 having a connecting end 37, from which leads 34,36 extend, and a free end 39 is mounted within chamber 29 so that the free end 39 is positioned at one end of the chamber 29, while the connecting end is positioned toward the other or open end 27 of the chamber with leads 34,36 extending outwardly through the open end of housing 28, from which they are connected to solenoid S. A small amount of sealing material 40 is spread around the connecting end 37 of mercury switch 32 after it is inserted into chamber 29 to seal the switch 32 therein and retain it within the chamber 29 so that it does not inadvertently become removed therefrom. As is the case with mercury switches, a bulb or drop of mercury 38 is included within the switch, and as long as the switch 32 is tilted with the free end 39 downwardly, the mercury remains out of engagement with the contacts of leads 34,36. When the free end 39 is tilted upwardly, the mercury 38 moves by gravity down to the connecting end and completes an electrical circuit across the contacts of leads 34,36.

An abutment means in the form of a finger 26 extends downwardly from the lower wall of housing 28 for engagement by lever 18 as will be discussed hereinafter. The finger 26 is longitudinally positioned toward the free end 39 of the mercury switch (the one end of the chamber) from the point of mounting through opening 30*a* so that when the finger 26 is in its downward-most position (as when lever 18 is not activated upwardly by pattern chain 14 of cam track 12,) the one end of the housing is also tilted downwardly. At this point it should be noted that the projection 30 and opening 30*a* are positioned off center of housing 28 toward the end 27 from which the leads 34,36 extend, so that normally the one end of housing 24 will tend to tilt downwardly, as the center of gravity of the housing 28 is to the right of the attachment point. When lever 18 activates the lug upwardly, the one end of housing 24 is moved to such extent that it is tilted upwardly, and the drop of mercury 38 is moved down into engagement with the contacts of leads 34,36. It is important to note here that the positioning of finger 26 with respect to the pivot projection 30, the size of the housing, and the size and length of the mercury switch 32 are all so related with each other that the lever 18, when activated, moves the mercury switch 32 to such an extent that the right hand end is lifted from a normal downwardly tilted position to a switch activated, upwardly tilted position. After the lug 16 on pattern chain 14 or cam 13 on cam track 12 passes, the switch housing 24 is again returned to its normal position.

In operation, then, during normal formation of the stocking when most of the knitting occurs and the drive belt is on the fast speed pulley, the lever 18 is in its lowermost position, so that the switch housing 24 has the one end (right hand end in FIG. 1) tilted downwardly. At some time slightly before a pattern change occurs, it is necessary to slow down the speed of the needle cylinder, and a lug 16 on pattern chain 14 or a cam 13 on cam track 12 causes the lever to move its upper position, whereupon the switch housing 24 becomes tilted upwardly, causing the mercury 38 in mercury switch 32 to move into engagement with the contacts of leads 34,36, thereby activating the solenoids to shift the drive belt to the slow speed pulley for the pattern change. Upon completion of a preselected number of courses, when it is desired to change the condition of the solenoid, another lug on pattern chain 14 or cam track 12 activates switch housing 24 again in the same manner to shift the solenoid to the opposite mode or position.

It should be noted that the switch mechanism according to the present invention, as in conventional practice, can be activated either from lugs 16 on the pattern chain 14 or cams 13 on cam track 12. The reason for this is that some of the pattern changes are controlled by the pattern chain 14, while some operations, necessitating a slow down in speed, are operated from the cam track 12.

Obviously the specific shape, size, and other characteristics and features of the switch housing could be altered significantly without departing from the scope of the invention. It is only necessary that a mercury switch be seated in some type of housing and positioned on the machine so that the mercury switch is normally tilted downwardly with the mercury out of engagement with the contacts of leads 34,36. Then, when it is time to signal the solenoid, the switch is moved to a position in which the free end of the switch is tilted upwardly and the mercury moved into engagement with the contacts of leads 34,36.

Thus, there are no moving parts to wear out as is the case with microswitches. Oil mist and vapors cannot work their way into the switch causing carbon deposits which eventually lead to malfunction, and there are no small springs or other parts to wear out. The life of the switch and switch housing according to the present invention is, therefore, almost unlimited, and should last substantially the life of the machine, thereby leading to considerable economic advantages over switches which accomplish the same function in accordance with known techniques.

Although a specific embodiment of the present invention has been shown and described hereinabove, it is recognized that certain modifications and changes could be made without departing from the scope of the invention, which is to be limited only by the following claims:

That which is claimed is:

1. In combination with a circular hosiery knitting machine, an improved cylinder speed control system of the type having lugs on the pattern chain and/or cams on the cam drum, a vertically reciprocal lever mechanism pivotally mounted to said machine in the path of said lugs and cams and activated in response to engagement by said lugs and cams, a switching mechanism in the path of and operated by said lever mechanism, and a speed control mechanism electrically connected to and operated by electrical pulses from said switching mechanism to shift a drive belt between a slow and fast pulley, wherein said switching mechanism comprises:

a. a housing having an elongated chamber therein and pivotally mounted to said machine for arcuate reciprocal movement between a first position in which one end of said chamber is tilted downwardly and a second position in which said one end is tilted upwardly;

b. a glass encapsulated mercury switch having leads extending therefrom and mounted in said chamber with said leads extending through the other end of said chamber opposite said one end, whereby, when said one end of the chamber is tilted downwardly, the mercury in said switch is out of engagement with the contacts of said leads, and when said one end is tilted upwardly, the mercury is in contact with said leads;

c. said housing including an abutment means thereon, engaged by said lever during operation, for moving said housing between said first and second positions responsive to movement of said lever by said pattern chain and cam drum.

2. In the combination of claim 1, the switching mechanism wherein said switch housing includes a pivotal mounting means positioned between the center of gravity of said housing and the other end of said housing, whereby said one end normally tends to tilt downwardly, and said abutment means is positioned between said pivotal mounting means and said one end.

3. The combinaton of claim 1 in which said other end of said chamber includes a sealing means to seal said glass encapsulated mercury switch therein.

4. In combination with a circular hosiery knitting machine, an improved cylinder speed control system of the type having lugs on the pattern chain and/or cams on the cam drum, a vertically reciprocal lever mechanism pivotally mounted to said machine in the path of said lugs and cams and activated in response to engagement by said lugs and cams, a switching mechanism in the path of and operated by said lever mechanism, and a speed control mechanism electrically connected to and operated by electrical pulses from said switching mechanism to shift a drive belt between a slow and fast pulley, wherein said switching mechanism comprises:

a. a glass encapsulated mercury switch having leads extending from contacts sealed therein through a base end, and a free end opposite said one end;

b. support means for pivotally mounting said mercury switch generally horizontally with the free end being movable between and off position tilted below the horizontal and an on position tilted above the horizontal; and c. said support means having a lever engaging position positioned in the path of said lever and being movable vertically responsive to the reciprocal movement of said lever, whereby a lifting of said lever will cause a resulting tilting upwardly of the free end of said mercury switch.

* * * * *